US008397637B2

(12) United States Patent
Behrens

(10) Patent No.: US 8,397,637 B2
(45) Date of Patent: Mar. 19, 2013

(54) METHOD AND APPARATUS FOR HANDLING PRINTING PLATES AND PRINTING PLATE EXPOSER

(75) Inventor: Gunnar Behrens, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 568 days.

(21) Appl. No.: 12/622,494

(22) Filed: Nov. 20, 2009

(65) Prior Publication Data

US 2010/0126369 A1 May 27, 2010

(30) Foreign Application Priority Data

Nov. 21, 2008 (DE) ..... 10 2008 058 551

(51) Int. Cl.
*B41L 47/14* (2006.01)

(52) U.S. Cl. ..... 101/477; 101/401.1

(58) Field of Classification Search ..... 101/401.1, 101/415.1, 477
See application file for complete search history.

(56) References Cited

U.S. PATENT DOCUMENTS

| | | | | |
|---|---|---|---|---|
| 6,213,020 | B1 | 4/2001 | Kawada et al. | |
| 7,165,493 | B2 | 1/2007 | Behrens | |
| 7,363,857 | B2 * | 4/2008 | Kawada et al. | 101/477 |
| 7,370,582 | B2 | 5/2008 | Behrens | |
| 7,941,332 | B2 * | 5/2011 | Liu et al. | 705/7.11 |
| 2001/0045171 | A1 * | 11/2001 | Fujishiro et al. | 101/477 |
| 2004/0168600 | A1 * | 9/2004 | Tobe et al. | 101/477 |
| 2006/0196376 | A1 * | 9/2006 | Piazza | 101/477 |
| 2007/0125251 | A1 * | 6/2007 | Bernard et al. | 101/477 |

FOREIGN PATENT DOCUMENTS

| | | | |
|---|---|---|---|
| DE | 4038545 | A1 | 6/1992 |
| DE | 10359667 | A1 | 7/2005 |
| JP | 200011484 | A | 1/2000 |
| JP | 2001001484 | A * | 1/2001 |

OTHER PUBLICATIONS

German Search Report dated Jun. 10, 2009.

* cited by examiner

*Primary Examiner* — Ren Yan
(74) *Attorney, Agent, or Firm* — Laurence A. Greenberg; Werner H. Stemer; Ralph E. Locher

(57) ABSTRACT

A method and an apparatus for handling printing plates which are fed to at least two process stations, include at least one receiving deck on which the printing plates are provided and fed to the different process stations by pivoting the receiving deck. The receiving decks are pivoted first of all about a first rotational axis and likewise about a second rotational axis which is different than the first, in order to ensure favorable receiving angles between the receiving deck and the individual process stations in each case for the printing plate transfer. A printing plate exposer having an apparatus for handling printing plates, is also provided.

13 Claims, 7 Drawing Sheets

METHOD AND APPARATUS FOR HANDLING PRINTING PLATES AND PRINTING PLATE EXPOSER

CROSS-REFERENCE TO RELATED APPLICATION

This application claims the priority, under 35 U.S.C. §119, of German Patent Application DE 10 2008 058 551.3, filed Nov. 21, 2008; the prior application is herewith incorporated by reference in its entirety.

BACKGROUND OF THE INVENTION

Field of the Invention

The invention relates to a method and an apparatus for handling printing plates being fed to at least two process stations, in which the printing plates are provided for feeding onto at least one receiving deck of a printing plate receiving device, and the at least one receiving deck is pivoted about a first rotational axis for transporting or for transferring a printing plate from a first process station to a second process station.

Before printing forms, for example printing plates, can be used in printing processes such as offset printing, they have to be imaged. Imaging devices such as external drum exposures, internal drum exposures or the like are used in order to image the printing plates.

The printing plates are introduced into the imaging device for imaging. For that purpose, the printing plates can be inserted individually by hand or they can be removed automatically from a cassette for printing plates. The cassette can in turn have been removed from a cassette supply. For example, single cassette loaders (SCL) and multiple cassette loaders (MCL) can be used for automatically or semiautomatically loading an imaging device. In a single cassette loader, a cassette which comes from a multiple cassette loader or has been fed to the SCL manually is loaded. Within the SCL, a printing plate is then separated from the cassette and is fed to the imaging device. A cassette can also be fed manually to the SCL in a semiautomatic process. Trays for providing printing plates are also known. In that case too, an uppermost plate is then separated from a stack by corresponding lifters and is fed to the imaging device.

Different imaging devices are necessary depending on the plate which is used. The plates can differ, for example, in relation to the necessary exposure wavelength. The respective imaging devices then have to have corresponding exposure heads which include, for example, laser diodes of the suitable wavelength.

After imaging, it can be necessary for the printing plate to also be transported into a developing unit (processor). That can be the case when the surface layer of the printing plate has not been removed ablatively during the exposure, in order to produce a printing image.

Depending on the plate type, the exposed or the unexposed regions of the surface layer are removed by the developing. Different chemicals or else different developing units can be necessary for that purpose.

When the printing plate has been developed, it is transported into a printing press, clamped into a corresponding imaging cylinder and can then be used in a printing operation.

If the printing image is produced in an ablative imaging process, subsequent developing of the printing plate is not absolutely necessary and the plate can be clamped into the printing press right away (in a processless manner).

Before or after the printing plate has been imaged, it can also be necessary for register holes to be punched into the printing plate. The printing plate is then transported into a corresponding punching apparatus for that purpose. The register holes serve to align the printing plate in register in the printing press or else in the imaging device. In particular, different register holes can be provided for the printing press and the imaging device. Different printing presses can also stipulate different register holes.

In a method for handling printing plates, in particular in the region of an imaging device for imaging the printing plates, it therefore has to be ensured that the printing plates are moved between the different stations which they pass through until they are clamped into a printing press.

If different printing plate types are used, it is to be ensured that the plates are treated in a manner which corresponds to their type. For that purpose, it can be necessary for the plates to then be moved to correspondingly different imaging devices and/or developing devices.

For that purpose, the printing plates can be moved between the different stations by hand by an operator. To that end, it can be the case, in particular, that the entire process has to be carried out in a yellow light region, in order to ensure that light-sensitive plates are not exposed erroneously.

It is also possible and usually desirable for the printing plates to be transported automatically back and forth between the different stations. In that case, it can be necessary for there to be separate processing paths for different printing plate types.

Combinations between an automatic and a manual method are also possible. For example, a printing plate can be inserted by hand into an imaging device and can subsequently be fed automatically to a developing device and can be developed there. It is also possible that a printing plate cassette is inserted by hand into an SCL and the remaining operation takes place automatically. Even in the case of those combinations, different processing paths with regard to the apparatuses can be necessary.

In order to move a printing plate automatically between two process stations, U.S. Pat. No. 6,213,020 describes a transport device which first of all transports a printing plate by a first transport path into a punching apparatus and then subsequently into an imaging device. After the imaging, the printing plate can then be received again by a second transport path of the transport device. It is not described how the transport device is incorporated into an automatic or semiautomatic processing path.

A printing plate is transported back and forth between the punching apparatus and the imaging device by the transport device which is described in U.S. Pat. No. 6,213,020, by the transport device being tilted in its entirety. For that purpose, the transport device is connected to an external drive through a complex configuration of cams and geared disks. Through step-up gear ratios, the drive generates a torque on the transport device which is then tilted about a fixed point, by way of which the transport device is connected to an outer apparatus. Basically, the transport device can be tilted between two stable states by that drive.

Furthermore, it is known from German Published, Non-Prosecuted Patent Application DE 103 59 667 A1, corresponding to U.S. Pat. Nos. 7,165,493 and 7,370,582, to feed one or two printing plates to different process stations on two receiving decks of a printing plate receiving device, by the entire printing plate receiving device being pivoted about a rotational axis which lies outside the printing plate receiving device.

As a result of those known transport paths, the printing plates are always offered to the process stations at an angle which is predefined fixedly from the geometry of the apparatus as a function of the process station and the receiving deck. That can be disadvantageous in the case of a printing plate transfer, since the printing plate is then bent in part to a pronounced extent.

SUMMARY OF THE INVENTION

It is accordingly an object of the invention to provide a method and an apparatus for handling printing plates, in particular in the region of an imaging device for imaging the printing plates, and a printing plate exposer, which overcome, avoid or at least reduce the hereinafore-mentioned disadvantages of the heretofore-known methods and apparatuses of this general type.

With the foregoing and other objects in view there is provided, in accordance with the invention, a method for handling printing plates. The method comprises providing at least first and second process stations for receiving printing plates, providing a printing plate receiving device having at least one receiving deck, feeding the printing plates onto the at least one receiving deck, pivoting the at least one receiving deck about a first rotational axis for transporting or transferring a printing plate from the first process station to the second process station, and pivoting the at least one receiving deck about a second rotational axis, being different from the first rotational axis, for receiving a printing plate from the first process station or for transferring a printing plate to the second process station.

There is provision, in particular, for this method to be carried out for handling printing plates in the region of an imaging device for imaging printing plates. In this case, it can, in particular, be a plate exposer, preferably an external drum plate exposer.

By virtue of the fact that the receiving deck is pivoted about a second rotational axis in addition to a first rotational axis, about which the complete printing plate receiving device including a receiving deck or decks for a printing plate can be pivoted, the angle, at which process stations are made accessible by the printing plate receiving device and by the receiving deck, can be varied over a relatively large region. In particular, the angle can be adapted in such a way that printing plates are always transferred to the process station and received from the latter at a desired predefined angle.

With the objects of the invention in view, there is also provided an apparatus for handling and feeding printing plates to at least two process stations. The apparatus comprises a printing plate receiving device having at least one receiving deck for receiving a printing plate. The at least one receiving deck is pivotable about a first rotational axis for transporting the at least one printing plate and making all of the process stations accessible by the at least one receiving deck for the received printing plate. The at least one receiving deck is pivotable at least about a second rotational axis. The first rotational axis is spatially different than the second rotational axis of the at least one receiving deck. In this way, as described, it is made possible to set the angle, at which process stations are made accessible.

In accordance with another feature of the invention, in order for it to be possible to make different process stations accessible, there is provision for process stations to be disposed on a cylinder circumferential surface around a center axis. According to the invention, the first rotational axis of the at least one receiving deck is different than the center axis, and the second rotational axis is provided in an edge region of the at least one receiving deck in the vicinity of the cylinder circumferential surface. Furthermore, both the first and the second rotational axes are to extend parallel to the center axis. In this case, the first rotational axis is to be spaced apart from the center axis in an opposite direction to the second rotational axis.

The provision of the first rotational axis at a point which is different than the center axis achieves a situation where one end of the at least one receiving deck is pivoted only in a relatively small volumetric region of the apparatus overall. That is to say, a relatively large volumetric region is intentionally accepted on the other end side of the receiving deck during pivoting and actuating of different process stations. In this way, a relatively large, closed volumetric region is advantageously produced, however, in at least one or two quadrants of the apparatus. The volumetric region is not affected by the receiving decks or by the printing plate receiving device if no process stations have to be provided in this case. Drive elements of the apparatus or other elements of a plate exposer can advantageously be provided in this case. It is considered to be an acceptable disadvantage that the process stations then have to be positioned closer to one another on that side of the receiving deck which is not spaced apart to such an extent from the first rotational axis.

In accordance with a further feature of the invention, in order to increase the process speed of the apparatus and of the method, there is provision for at least two receiving decks to be encompassed by the printing plate receiving device. In this case, both receiving decks should be pivotable both about the first rotational axis and about the second rotational axis. In this way, a first alignment of the printing plate receiving device can be performed through the use of the first rotational axis, by pivoting of the printing plate receiving device per se, and the desired angle of the respective receiving deck with respect to the process station can then be set by pivoting of at least one of the two receiving decks about the second rotational axis.

In accordance with an added feature of the invention, the two receiving decks preferably enclose a first angle $\phi$ with one another relative to the second rotational axis and are to be positionally fixed with respect to one another. The two receiving devices are then to be pivoted jointly by a second angle $\phi$ about the first rotational axis, with the angle which is enclosed by them with respect to one another being maintained. In order for a process station to be made accessible by a first or second receiving deck, the two receiving decks, after pivoting by a second angle about the first rotational axis, can then be pivoted jointly about the second rotational axis, preferably by a third angle which is identical to the first angle. In this way, the geometry, with which an identical angle of the respective receiving decks with respect to the process stations is always ensured, will already be predefined in the position of the receiving decks with respect to one another in the printing plate receiving device.

In accordance with an additional feature of the invention, the angle which the two receiving decks enclose with respect to one another and by which the receiving decks can be pivoted about the second rotational axis, preferably lies in the range of 8°. As a result, the volumetric region which is made accessible by the receiving decks can be minimized and, at the same time, an identity of the angle can be achieved, at which the process stations are made accessible by both of the receiving decks.

In accordance with yet another feature of the invention, in one preferred embodiment of the method, there is provision for first of all a printing plate transfer device to be provided as a first process station of a printing plate exposer, for a first printing plate to be fed from the printing plate transfer device to a first receiving deck and, furthermore, for an exposer drum of a printing plate exposer to be provided as a second process station. The printing plate receiving device can then be pivoted by a second angle about the first rotational axis with the received printing plate on the first receiving deck. In this way, the exposer drum of the printing plate exposer is made accessible by the second receiving deck. If a second printing plate is then situated on the exposer drum, the second printing plate is transferred from the exposer drum onto the second receiving deck, while the first printing plate is still situated on the first receiving deck. In the next step, the first and second receiving decks are then pivoted jointly relative to a frame of the printing plate receiving device. In this case, the pivoting takes place by a third angle around the second rotational axis. The third angle preferably has the same size as the angle which the two receiving decks enclose with respect to one another, particularly preferably 8°. In general, however, this angle is to be selected in such a way that a receiving face of the first receiving deck encloses an approximately identical angle with respect to the exposer drum as before the pivoting of a receiving face of the second receiving deck.

In accordance with yet a further feature of the invention, after the two receiving decks have then been pivoted relative to the frame of the printing plate receiving device in such a way that the first receiving deck encloses the same angle with the exposer drum as the second receiving deck previously, the first printing plate is transferred from the first receiving deck to the exposer drum.

In this way, it is provided that printing plates are always transferred from and to the exposer drum at the same angle. In this case, the angle is selected in such a way that the printing plates are as far as possible not curved, or only slightly curved.

In accordance with yet an added feature of the invention, for this purpose, there is provision in terms of apparatuses, for the printing plate receiving device to have an outer frame, for the frame to be connected to the first rotational axis, with the result that the printing plate receiving device can be pivoted jointly with the receiving decks about the first axis, for the frame to include, furthermore, the second rotational axis, with the result that the receiving decks can be pivoted about the second rotational axis relative to the frame, preferably by an angle of approximately 8°. In this way, firstly the entire printing plate receiving device can be pivoted jointly with the positionally fixed receiving decks in a first step, and the two receiving decks can be pivoted jointly relative to the printing plate receiving device in a second step.

Of course, each receiving deck can also be pivoted per se independently of others.

With the objects of the invention in view, there is concomitantly provided a printing plate exposer, comprising an apparatus for handling printing plates having the above-described features, and at least two process stations selected from the group including an exposer drum, a printing plate receiving device, a printing plate punch and a transport table, in which it is possible for the at least two process stations to be made accessible by the apparatus.

Other features which are considered as characteristic for the invention are set forth in the appended claims.

Although the invention is illustrated and described herein as embodied in a method and an apparatus for handling printing plates and a printing plate exposer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
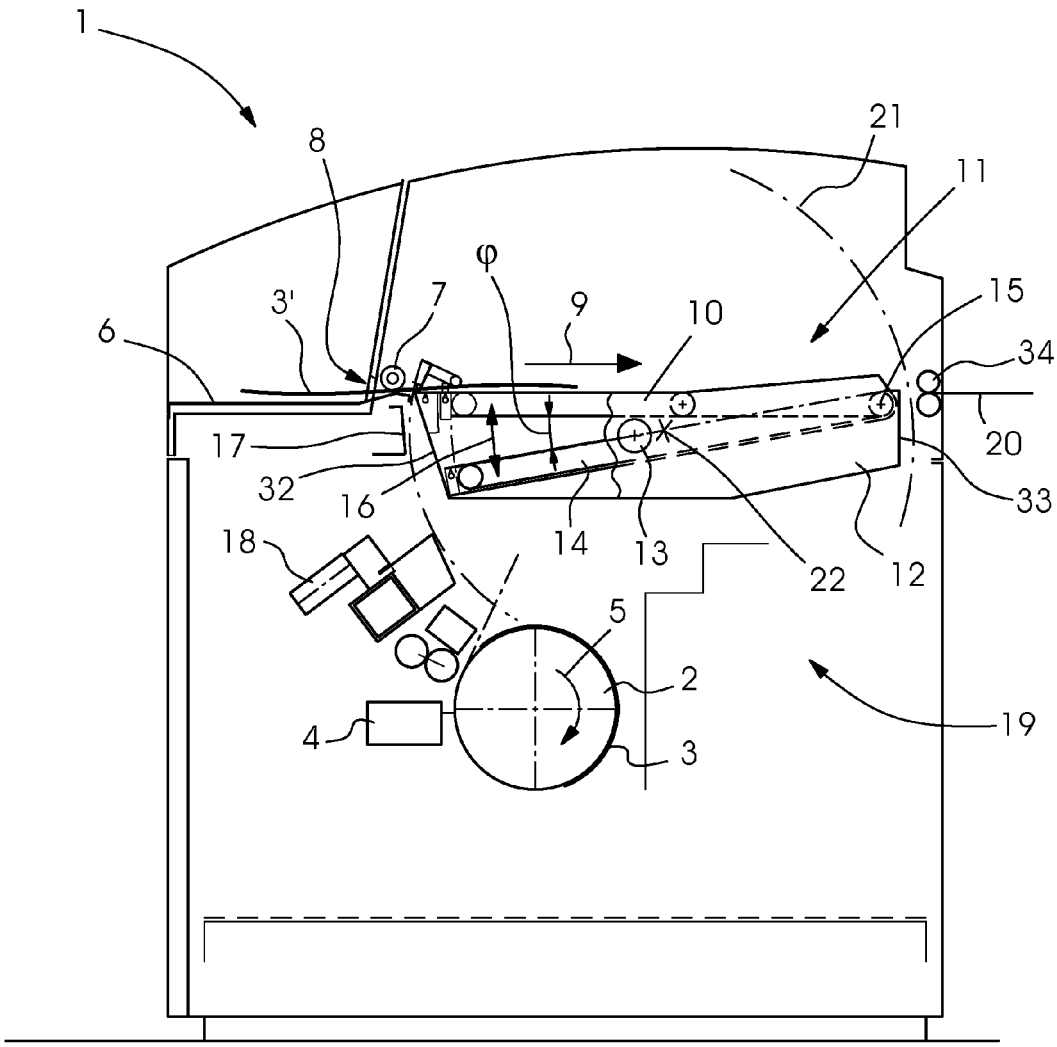
FIG. 1 is a diagrammatic, vertical-sectional view of a plate exposer in a first receiving position.

Referring now to the figures of the drawings in detail and first, particularly, to FIG. 1 thereof, there is seen a sectional view of a plate exposer 1. The plate exposer 1 is a semiautomatic machine, to which printing plates 3, 3' are transferred manually by a printing plate transfer device 8. For this purpose, the plate exposer 1 has a feed table 6 at an inlet side. In order to image the printing plates 3, 3', the plate exposer 1 includes an exposer drum 2, onto which a printing plate 3 is clamped. In order to image the printing plate 3, it is moved rotationally with the drum 2 in the direction of a rotational arrow 5 and is imaged by an exposing element 4 which extends or can be moved parallel to the axis of the exposer drum 2.

The plate exposer 1 has a printing plate receiving device 11 in order to handle printing plates 3' which are fed in and printing plates 3 which are clamped on the exposer drum 2. The printing plate receiving device 11 includes a first and a second receiving deck 10, 14 within an outer frame 12. The outer frame 12 can have journals, for example, which are mounted in a bearing of the plate exposer 1, with the result that a first rotational axis 13 is realized through the journals.

The frame 12 has a front region 32 and a rear region 33. In this case, the first rotational axis 13 of the frame 12 or of the printing plate receiving device 11 does not lie centrally in the middle between the front and the rear regions 32, 33, but rather is displaced in the direction of the front region 32.

The first receiving deck 10 and the second receiving deck 14 are mounted within the frame in a positionally fixed manner with respect to one another in such a way that they can be pivoted about a second rotational axis 15 relative to the frame 12, that is to say with respect to the printing plate receiving device 11 in the direction of a double arrow 16. In this case, the second rotational axis 15 is situated in the rear region 33 of the printing plate receiving device 11, while the two receiving decks 10 and 14 are disposed at an opening angle $\phi$ with respect to one another in such a way that they are spaced apart from one another in the front region 32 of the printing plate receiving device 11. For this purpose, the two receiving decks 10, 14 enclose an angle $\phi$ of approximately 8°.

The plate exposer 1 includes a plurality of process stations 8, 2, 17, 18 and 20 for printing plates 3, 3'. The process stations are disposed in practice on a cylinder circumferential surface 21 about a center axis 22. In this case, the first rotational axis 13 of the printing plate receiving device 11 is different than the center axis 22 and is displaced in the direction of the front region 32. In this case, the first rotational axis 13 lies in the region of the printing plate receiving device 11.

The process stations are firstly the printing plate transfer device 8, through which, for example through the use of transport rollers 7, a printing plate 3' is transferred from a feed table 6 to the first receiving deck 10, by moving the printing plate 3' onto the receiving deck 10 in the direction of an arrow 9.

Further process stations are an aligning plate 17 for the horizontal alignment of a printing plate 3' at its front edge, and a plate punch 18 for punching the printing plates 3, 3' before and/or after the exposure of the printing plates 3, 3' with register punched portions for register pins on the exposer drum 2 and/or for aligning pins in a printing press (which is not shown in further detail).

The exposer drum 2 with the associated exposing element 4 is a further process station of the plate exposer 1.

Furthermore, in the embodiment example, an external transport table 20 with associated transport rollers 34 is provided as a further process station. A printing plate 3, 3' can be transported over the transport table 20 after the exposure, substantially horizontally out of the plate exposer 1 in the direction of the arrow 9. The transport table 20 can be configured in such a way that it can be folded away.

In addition to the process stations which are shown and described in this case, further process stations can also be provided.

The process stations 8, 17, 18, 2 are disposed counter to the clockwise direction on the cylinder circumferential surface 21 in such a way that they can be made accessible by the front region 32 of the printing plate receiving device 11 for printing plates 3, 3'.

The external transport table 20 is situated on that side of the cylinder circumferential surface 21 which is opposite the printing plate transfer device 8 and can be made accessible by its rear region 33 for the printing plates 3, 3'. The printing plates 3, 3' can be fed by the printing plate receiving device 11 to the corresponding process stations, either from the first receiving deck 10 or the second receiving deck 14.

As a result of the displacement of the rotational axis 13 of the printing plate receiving device 11 toward the front region 32 in relation to the center axis 22 of the cylinder circumferential surface 21, the front region 32 of the printing plate receiving device 11 covers only a lower quadrant of the plate exposer 1. As a result, although the rear region 33 of the printing plate receiving device is pivoted over a larger region in the right upper quadrant of the plate exposer, a situation is achieved where a large installation region 19 is made available in the lower right quadrant of the plate exposer 1 in such a way that the printing plate receiving device 11 does not move into it. Drives and a device of the printing plate exposer 1 can then be provided in this installation region 19. In this case, it only matters that this installation region 19 is situated in a lower quadrant, whether it be the left or the right quadrant, of the plate exposer 1. Since the installations which are provided in this case are relatively heavy elements and devices, they are advantageously provided in the lower region of the plate exposer 1 and the upper region can be free of elements in such a way that it can be passed through without problems by the rear region 33 of the printing plate receiving device 11.

FIG. 1 shows a state of the plate exposer 1, in which state a printing plate 3 is situated on the exposer drum 2 for imaging, while at the same time a further printing plate 3' is transferred from the feed table 6 through the printing plate transfer device 8 onto the first receiving deck 10.

FIGS. 2 to 6 show different functional states of the plate exposer 1, in which states the printing plates 3 and 3' are transferred to the different process stations 8, 17, 18, 2 and 20. Identical elements are provided with identical designations, with the labeling of non-important elements having been omitted from the corresponding figures for the sake of clarity.

Figure 2:
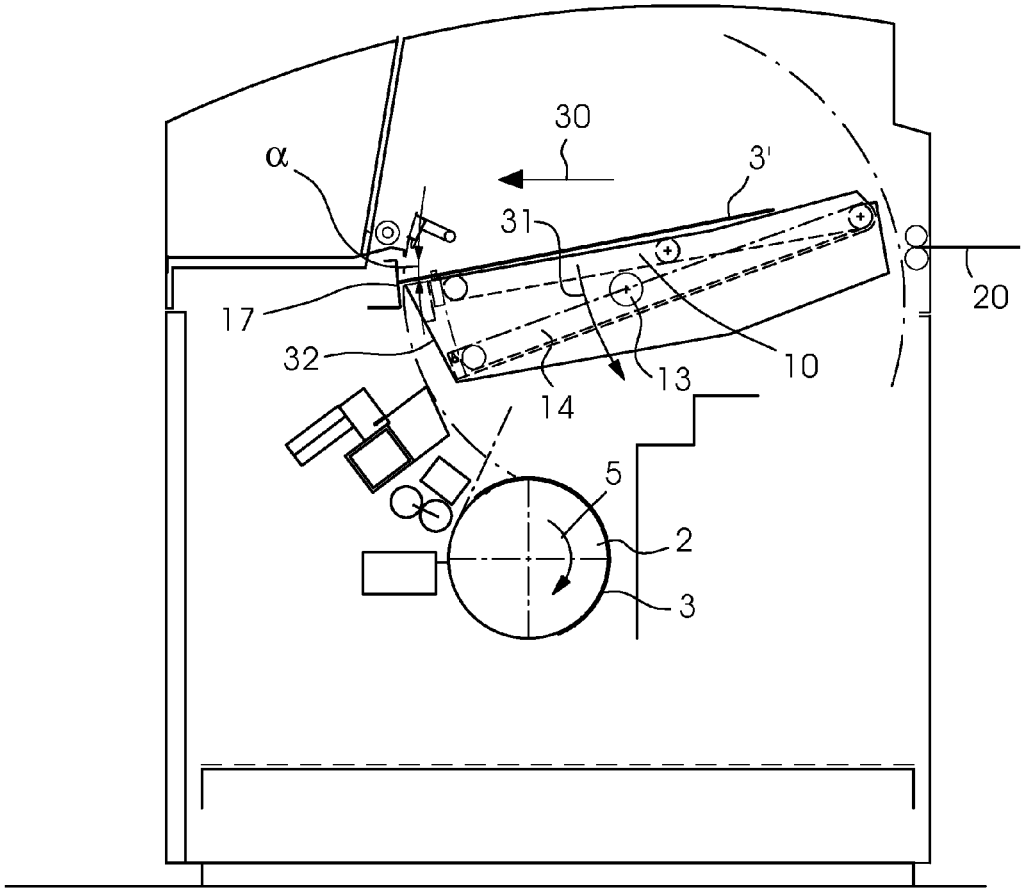
FIG. 2 is a vertical-sectional view of the plate exposer in an aligning position.

FIG. 2 shows the plate exposer 1 with a printing plate receiving device 11 which is pivoted in the direction of a rotational arrow 31. In this case, the printing plate receiving device 11 has been pivoted by an angle $\alpha$ about the first rotational axis 13, with the result that the first receiving deck 10, that is to say the upper receiving deck, has been pivoted into a plane, so that the printing plate 3' which is situated on the first receiving deck 10 can be moved for alignment against an aligning plate 17 which is provided in front of the front region 32 of the printing plate receiving device. For this purpose, a drive device can be provided on the first receiving deck 10. However, the surface of the first receiving deck 10 preferably has a particularly low-friction configuration, with the result that the printing plate 3' can slide for alignment against the aligning plate 17, due to the action of gravity and optionally assisted by non-illustrated conveyor belts. The printing plate 3' is then aligned parallel to the aligning plate 17. The printing plate 3' can subsequently be moved back onto the receiving deck 10 by the non-illustrated drive device.

Figure 3:
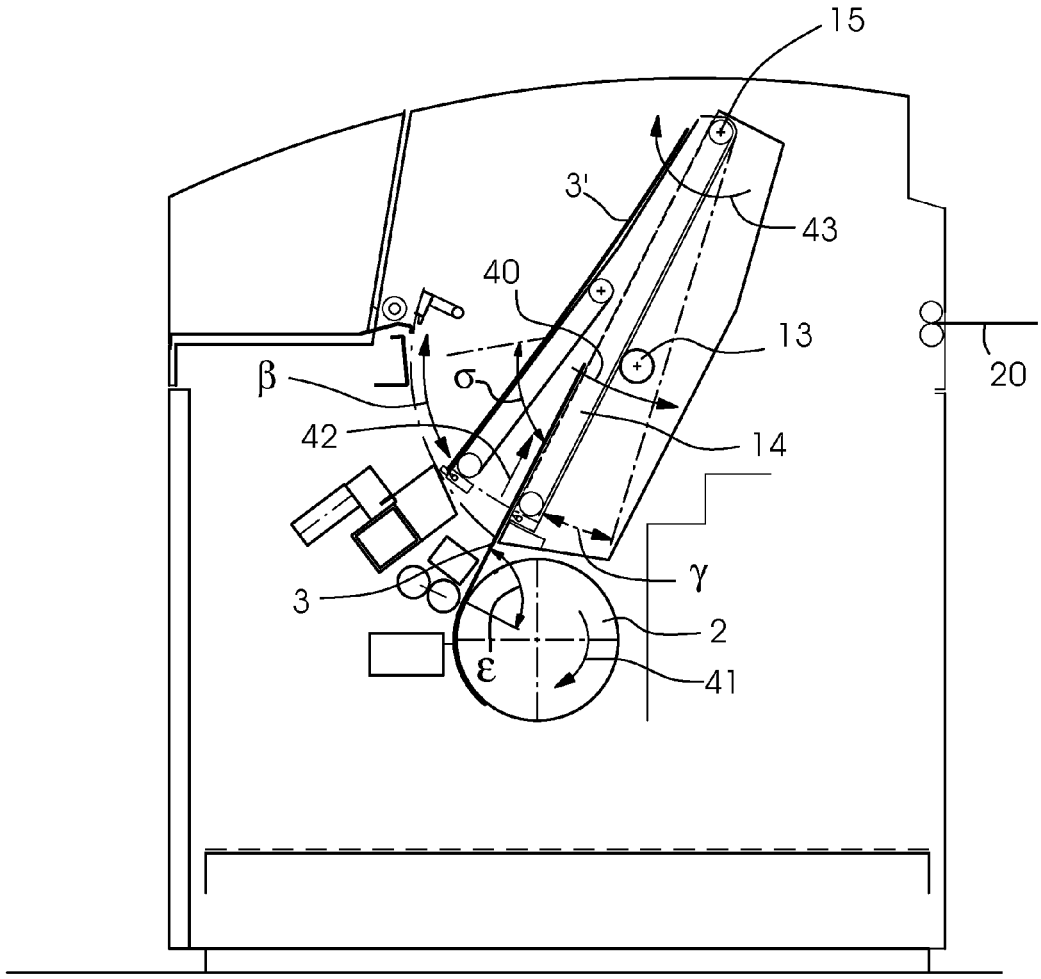
FIG. 3 is a vertical-sectional view of the plate exposer in an unloading position.

FIG. 3 shows a state of the plate exposer 1, in which state both the printing plate receiving device 11 is pivoted about the first rotational axis 13 and the two receiving decks 10, 14 are pivoted about the second rotational axis 15.

In this case, the printing plate receiving device 11 has been pivoted about the first rotational axis 13 in the direction of the rotational arrow 40 counter to the clockwise direction, while the two receiving decks 10, 14 have been pivoted about the second rotational axis 15 in the opposite direction, in the direction of a rotational arrow 43. In this case, the two receiving decks 10, 14 have been pivoted by an angle $\gamma$ which corresponds to the opening angle $\phi$ of the receiving decks 10, 14 and is advantageously to be 8°, in the opposite direction of the printing plate receiving device 11 in the clockwise direction. In this case, the printing plate receiving device 11 is pivoted by an angle $\sigma$ counter to the clockwise direction in the direction 40 in such a way that, resulting from the two pivoting movements in opposite directions of the receiving decks 10, 14 and the printing plate receiving device 11, the lower second receiving deck 14 encloses a receiving angle $\epsilon$ with respect to the exposer drum 2 and overall the upper first receiving deck 10 has been pivoted by a resulting angle $\beta$ in the direction 40.

In this way, the printing plate receiving device 11 assumes a suitable position for unloading the exposer drum 2. The printing plate 3 which is clamped on the exposer drum 2 can be transferred from the exposer drum 2 to the receiving deck 14, while the exposer drum 2 rotates in the direction of an arrow 41.

Figure 4:
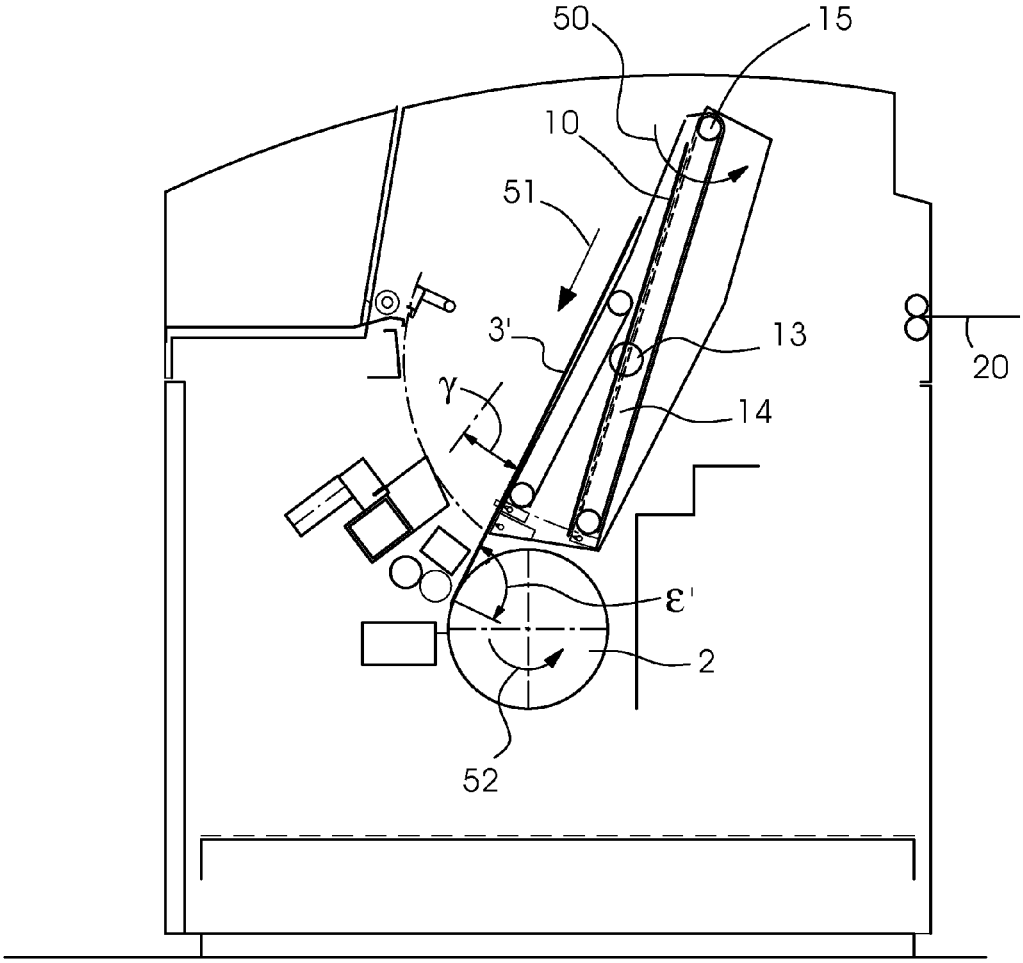
FIG. 4 is a vertical-sectional view of the plate exposer in a loading position.

When the unloading operation for the printing plate 3 is concluded, two printing plates 3, 3' are situated in the printing plate receiving device 11, while the exposer drum 2 is then without a printing plate. The printing plate receiving device and the first and second receiving decks 10, 14 can be pivoted out of the unloading position which is shown in FIG. 3 into a further loading position as shown in FIG. 4, for reloading the exposer drum 2 with a printing plate 3'.

In order to load the exposer drum 2 with the printing plate 3' which is provided on the first receiving deck 10, the printing plate receiving device 11 remains in the same position as it also assumed for unloading. Just the two receiving decks 10, 14 are jointly pivoted again by the angle γ counter to the clockwise direction in the direction of a rotational arrow 50, again about the second rotational axis 15, with the result that the upper first receiving deck 10 then encloses an angle ϵ' with the exposer drum 2, which angle ϵ' is identical to the angle ϵ. The printing plate 3' is then moved from the first receiving deck 10 to the exposer drum 2, at least with the assistance of its weight in a direction 51, and is clamped onto the exposer drum 2 with simultaneous rotation of the exposer drum 2 in a direction 52.

The possible pivoting of the printing plate receiving device about the first rotational axis 13 and the pivoting of the two receiving decks 10, 14 about the second rotational axis 15 ensure that printing plates 3, 3' are loaded onto and unloaded from the exposer drum 2 in each case at the same angle ϵ, ϵ'.

Figure 5:
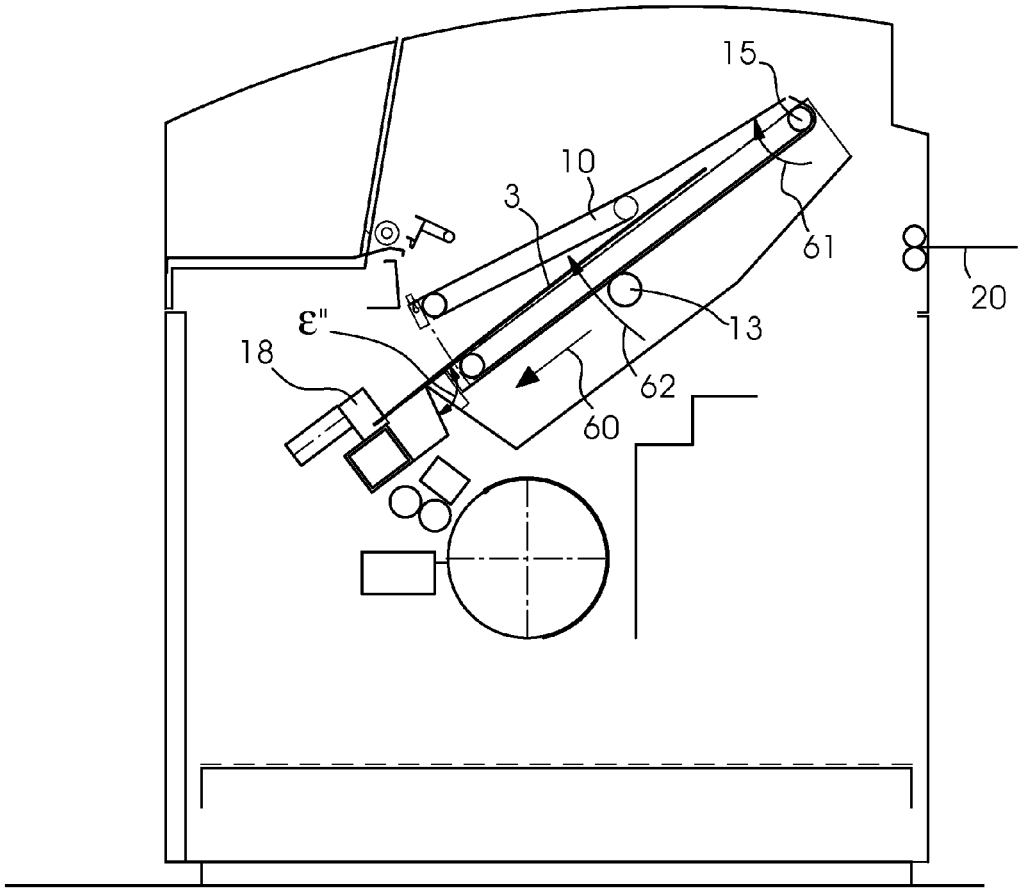
FIG. 5 is a vertical-sectional view of the plate exposer in a punching position.

In a further method step shown in FIG. 5, the printing plate 3 which has previously been unloaded from the exposer drum 2 is then punched in the plate punch 18 with register holes for a non-illustrated printing press. For this purpose, first of all the printing plate receiving device 11 is pivoted around the first rotational axis 13 in a direction 62, and at the same time the two receiving decks 10, 14 are pivoted about the second rotational axis 15 in such a way that the lower second receiving deck encloses a receiving angle ϵ" with the printing plate 3 situated on it with respect to the plate punch 18. In this case, the corresponding pivoting angles about the first and second rotational axes 13, 15 are also advantageously selected in such a way that the resulting receiving angle ϵ" ensures that buckling or bending of the printing plate 3 is not required during feeding to the plate punch 18. The receiving angle ϵ" advantageously encloses an angle of approximately 90° with the perpendicular with respect to a non-illustrated receiving device of the plate punch 18. The same is true of the receiving angles ϵ, ϵ' as shown in FIG. 4, with the receiving angles ϵ, ϵ' enclosing an angle of 90° with the perpendicular of the contact point of the printing plate 3' with the exposer drum 2.

Furthermore, as shown in FIG. 5, the printing plate 3 which is situated on the second receiving deck 14 is therefore moved in the direction of an arrow 60 to the plate punch 18. This can firstly take place through the use of non-illustrated drive elements such as rollers or conveyor belts, or else can be assisted by the weight of the plate 3. After punching of the printing plate 3 in the plate punch 18, the plate 3 is moved back again completely onto the second receiving deck 14.

The printing plate 3 has then been processed completely in the plate exposer 1, with the result that it can be forwarded to further processing devices which are provided outside the plate exposer 1 or to a printing press (not shown herein in further detail).

Figure 6:
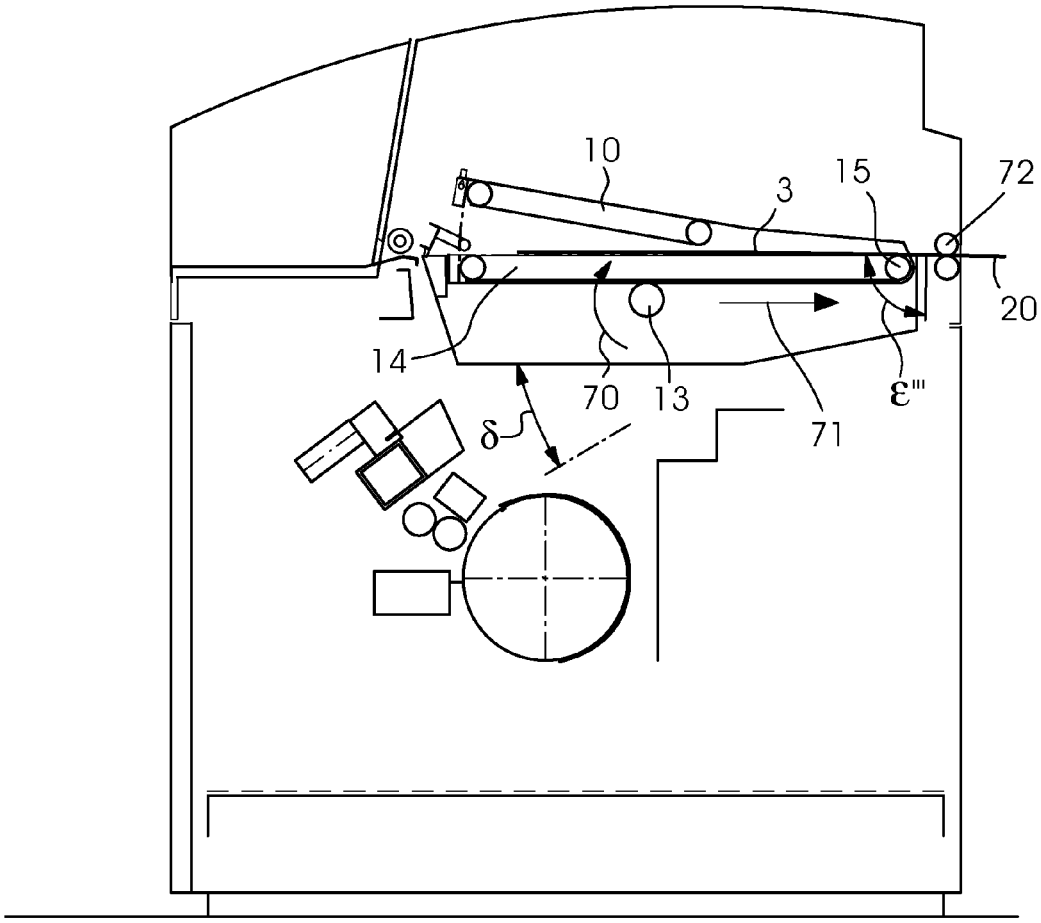
FIG. 6 is a vertical-sectional view of the plate exposer in a discharging position.

FIG. 6 therefore shows how the printing plate receiving device 11 is moved into a corresponding discharging position for the printing plate 3.

For this purpose, the printing plate receiving device 11 is moved by an angle δ about the first rotational axis 13 in the direction 70 counter to the clockwise direction, while the first and second receiving decks 10, 14 do not move about the second rotational axis 15 in each case in a positionally fixed manner. However, the angle δ is selected in such a way that the second receiving deck 14 then encloses a receiving angle ϵ''' with a perpendicular of the external transport table 20, which receiving angle ϵ''' should also again advantageously be 90°. The printing plate 3 which is provided on the second receiving deck 14 is then moved in the direction of an arrow 71 from the receiving deck 14 in the direction of the external transport table 20, optionally with the assistance of drive rollers 72 which are assigned to the external transport table 20. At this point, the printing plate 3 can be accepted by an outside operator, can be transferred to a further non-illustrated transport table for a developer, or can be transferred automatically to a printing plate cassette or another transport device for transporting the printing plate 3 to a printing press. For this purpose, the external transport table 20 can, in particular, have a pivotable construction, with the result that, in the case of non-use, it can be pivoted against the outer flank of the plate exposer 1.

As a result of the positions of the receiving decks 10, 14 and the printing plate receiving device 11 shown herein, it is possible that, for discharging or receiving a printing plate 3, 3' to outside process stations, each printing plate 3, 3' always encloses a particularly preferred receiving angle ϵ, ϵ', ϵ", ϵ''' of advantageously 90° with respect to a perpendicular to the receiving surface of the corresponding process station.

Figure 7:
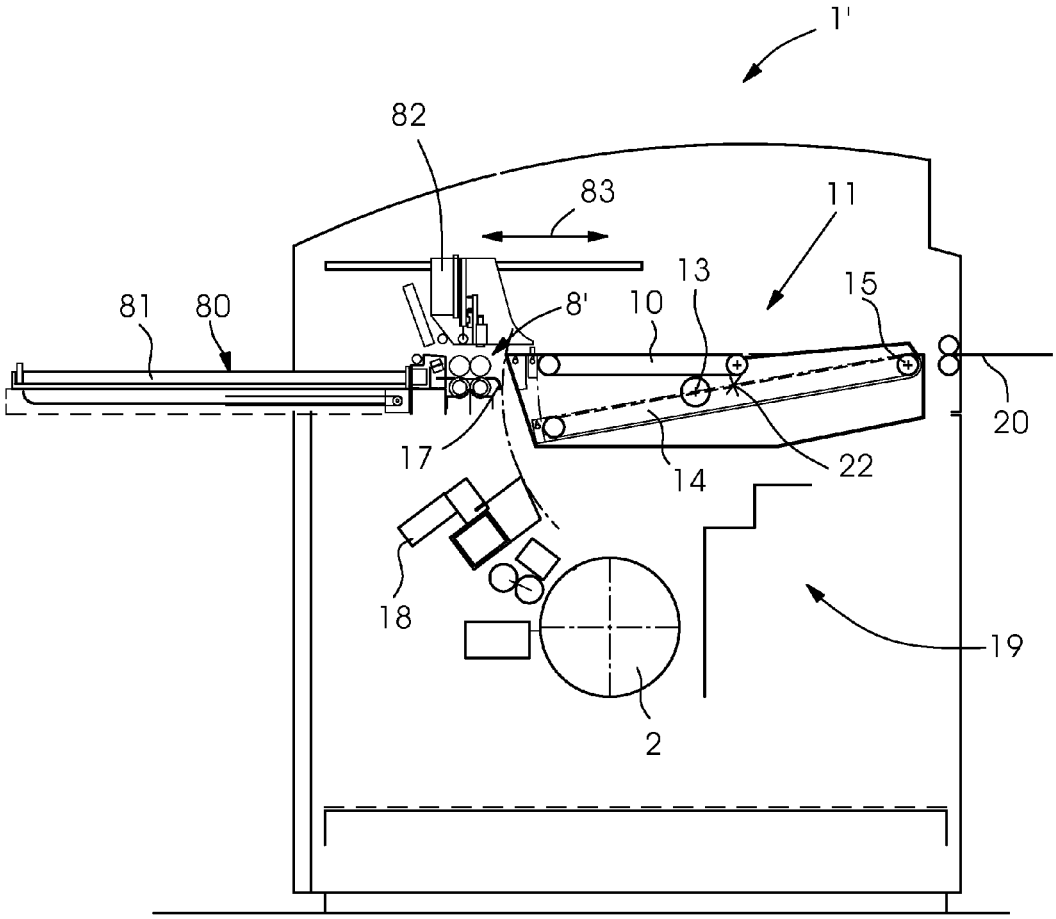
FIG. 7 is a vertical-sectional view of an alternative embodiment of the plate exposer as a fully automatic machine.

FIG. 7 shows a further plate exposer 1' in an alternative embodiment, with the printing plate receiving device 11 being configured with first and second receiving decks 10 and 14 identically to the version of the plate exposer in FIGS. 1 to 6.

In this alternative embodiment of the plate exposer 1', the printing plates 3, 3' are not transferred individually over a feed table 6 to the printing plate transfer device 8, but rather an automatic version of a plate exposer 1' is shown, in which the printing plates 3, 3' are made available to the plate exposer 1' in the manner of a printing plate stack 81 on a printing plate tray 80. In this case, the printing plate tray 80 is situated in a region in front of a printing plate transfer device 8' which is configured functionally in a similar manner to the printing plate transfer device 8 of the plate exposer 1. In order to transfer the printing plates from the printing plate stack 81 to the printing plate receiving device 11, the individual printing plates are transferred to the receiving deck 10 through the use of a separating apparatus 82 which is disposed displaceably in a horizontal direction 83 above the printing plate transfer device 8' and the printing plate stack 81. For this purpose, the separating apparatus 82 can have, in particular, suction grippers which can raise and separate the printing plates of the printing plate stack 81 in the front region. Then, as described with regard to FIGS. 1 to 6, the printing plates which are transferred to the printing plate receiving device 11 or to the first receiving deck 10 can be moved to the different process stations 17, 18, 2 and 20 of the printing plate exposer 1'. These process stations 17, 18, 2 and 20 are identical to the corresponding stations of the printing plate exposer 1.

As depicted, the printing plates 3, 3' can then always assume particularly favorable angles with respect to the individual process stations, both for unloading and for loading. Moreover, a lower installation region 19 for operating device of the plate exposer 1, 1' can be kept clear of the printing plate receiving device 11 in such a way that the drive device for the exposer drum 2 or the printing plate receiving device 11 can be provided in this case. This is achieved, in particular, through the displacement of the first rotational axis 13 relative to the center axis 22 of the cylinder shell 21, on which the individual process stations 17, 18, 2 and 20 are situated.

The invention claimed is:

1. An apparatus for handling and feeding printing plates to at least two process stations, the apparatus comprising:

a printing plate receiving device having at least one receiving deck for receiving a printing plate;

said at least one receiving deck being pivotable about a first rotational axis for transporting the at least one printing plate and making all of the process stations accessible by said at least one receiving deck for the received printing plate;

said at least one receiving deck being pivotable at least about a second rotational axis; and said first rotational axis being spatially different than said second rotational axis of said at least one receiving deck;

said at least one receiving deck being at least two receiving decks encompassed by said printing plate receiving device, and said at least two receiving decks being pivotable about said first and second rotational axes; and said at least two receiving decks being positionally fixed relative to one another and coupled to one another through said second rotational axis for enclosing a fixed angle greater than 0°.

2. The apparatus according to claim 1, which further comprises a virtual cylinder circumferential surface disposed around a virtual center axis, said at least one receiving deck having an edge region, the process stations being disposed along said virtual cylinder circumferential surface, said first rotational axis of said at least one receiving deck being different than said virtual center axis, and said second rotational axis being provided in said edge region of said at least one receiving deck in vicinity of said virtual cylinder circumferential surface.

3. The apparatus according to claim 2, wherein each of said first and second rotational axes lie in a horizontal direction, and said first rotational axis is disposed in a position displaced relative to said virtual center axis in a direction opposite to said second rotational axis.

4. The apparatus according to claim 1, wherein said fixed angle is approximately 8°.

5. The apparatus according to claim 1, wherein:

said printing plate receiving device has an outer frame connected to said first rotational axis permitting said printing plate receiving device to be pivoted jointly with said at least two receiving decks about said first rotational axis; and said frame includes said second rotational axis permitting said at least two receiving decks to be pivoted about said second rotational axis relative to said frame.

6. The apparatus according to claim 5, wherein said at least two receiving decks are pivotable about said second rotational axis through an angle of approximately 8° relative to said frame.

7. A printing plate exposer, comprising:

an apparatus for handling printing plates according to claim 1; and at least two process stations being selected from the group consisting of an exposer drum, a printing plate receiving device, a printing plate punch and a transport table, said at least two process stations configured to be accessible by said apparatus.

8. A method for handling printing plates, the method comprising the following steps:

providing at least first and second process stations for receiving printing plates;

providing a printing plate receiving device having at least one receiving deck, the at least one receiving deck being pivotable about a first rotational axis for transporting the at least one printing plate and making all of the process stations accessible by the at least one receiving deck for the received printing plate, the at least one receiving deck being pivotable at least about a second rotational axis, and the first rotational axis being spatially different than the second rotational axis of the at least one receiving deck;

providing the at least one receiving deck as at least two receiving decks encompassed by the printing plate receiving device, and the at least two receiving decks being pivotable about the first and second rotational axes, and the at least two receiving decks being positionally fixed relative to one another and coupled to one another through the second rotational axis for enclosing a fixed angle greater than 0°;

feeding the printing plates onto the at least one receiving deck;

pivoting the at least one receiving deck about the first rotational axis for transporting or transferring a printing plate from the first process station to the second process station; and pivoting the at least one receiving deck about the second rotational axis for receiving a printing plate from the first process station or for transferring a printing plate to the second process station.

9. The method according to claim 8, which further comprises:

placing the process stations around a virtual cylinder circumferential surface having a virtual horizontal center axis;

providing the second rotational axis in an outer region of the at least one receiving deck;

spacing the first rotational axis apart from the virtual horizontal center axis in a direction opposite to the second rotational axis; and aligning both the first and the second rotational axes parallel to the virtual horizontal center axis.

10. The method according to claim 8, which further comprises:

jointly pivoting both of the receiving decks about the first rotational axis through a second angle; and jointly pivoting both of the receiving decks about the second rotational axis, in order to make a process station accessible by the first or second receiving deck.

11. The method according to claim 10, which further comprises carrying out the step of jointly pivoting both of the receiving decks about the second rotational axis through a third angle being identical to the first angle.

12. The method according to claim 10, which further comprises:

providing a printing plate transfer device as the first process station of a printing plate exposer;

feeding a first printing plate from the printing plate transfer device to a first one of the receiving decks;

providing an exposer drum of the printing plate exposer as the second process station;

pivoting the printing plate receiving device through the second angle about the first rotational axis, making the exposer drum accessible by a second one of the receiving decks;

enclosing a receiving angle between the second receiving deck and the exposer drum;

transferring a second printing plate from the exposer drum to the second receiving deck;

pivoting the first and second receiving decks through a third angle about the second rotational axis, relative to a frame of the printing plate receiving device;

selecting the third angle in such a way that a receiving surface of the first receiving deck encloses approximately the same angle with the exposer drum as before the pivoting of a receiving surface of the second receiving deck; and transferring the first printing plate from the first receiving deck to the exposer drum.

13. An apparatus for handling printing plates, the apparatus comprising:

at least two process stations for receiving the printing plates;

a printing plate receiving device having at least one receiving deck for receiving a printing plate;

said at least one receiving deck being pivotable about a first rotational axis for transporting the at least one printing plate and making all of said process stations accessible by said at least one receiving deck for the received printing plate;

said at least one receiving deck being pivotable at least about a second rotational axis; and said first rotational axis being spatially different than said second rotational axis of said at least one receiving deck;

said at least one receiving deck being at least two receiving decks encompassed by said printing plate receiving device, and said at least two receiving decks being pivotable about said first and second rotational axes; and said at least two receiving decks being positionally fixed relative to one another and coupled to one another through said second rotational axis for enclosing a fixed angle greater than 0°.

* * * * *